United States Patent [19]

Bartlett

[11] 4,283,728

[45] Aug. 11, 1981

[54] FIVE-HORN CASSEGRAIN ANTENNA

[75] Inventor: Homer E. Bartlett, Cocoa, Fla.

[73] Assignee: Harris Corporation, Cleveland, Ohio

[21] Appl. No.: 885,191

[22] Filed: Mar. 10, 1978

[51] Int. Cl.[2] ..... H01Q 19/18

[52] U.S. Cl. ..... 343/781 CA; 343/837

[58] Field of Search ..... 343/16 M, 777, 778, 343/779, 853, 854, 837, 781 CA

[56] References Cited

U.S. PATENT DOCUMENTS

| | | | |
|---|---|---|---|
| 3,495,262 | 2/1970 | Paine | 343/16 M |
| 3,568,204 | 3/1971 | Blaisdell | 343/781 CA |

OTHER PUBLICATIONS

Sciambi; Microwaves; Jun. 1972, pp. 56, 57, 58.

*Primary Examiner*—Eli Lieberman

*Attorney, Agent, or Firm*—Craig and Antonelli

[57] ABSTRACT

A five-horn Cassegrain antenna is disclosed comprising a main dish, an up-taper subreflector set on the boresight axis of the main dish, and including a sum horn positioned on the boresight axis between the subreflector and the main dish with four error horns set therearound. The aperture of the sum horn is relatively large to substantially eliminate radiation spillover at the up-taper subreflector. The error horns are positioned around this large aperture sum horn such that the radiation patterns of paired error horns will crossover in their sidelobes. These error horns are provided with a high aspect ratio with the narrow dimension of each error horn being located in the plane of its tracking crossover with the radiation pattern of the other error horn with which it is paired. The foregoing antenna design combination results in a high illumination efficiency antenna wherein the radiation patterns of the error horns crossover in substantially increased sidelobes of the respective patterns thereby facilitating the accurate determination of a difference null.

7 Claims, 12 Drawing Figures

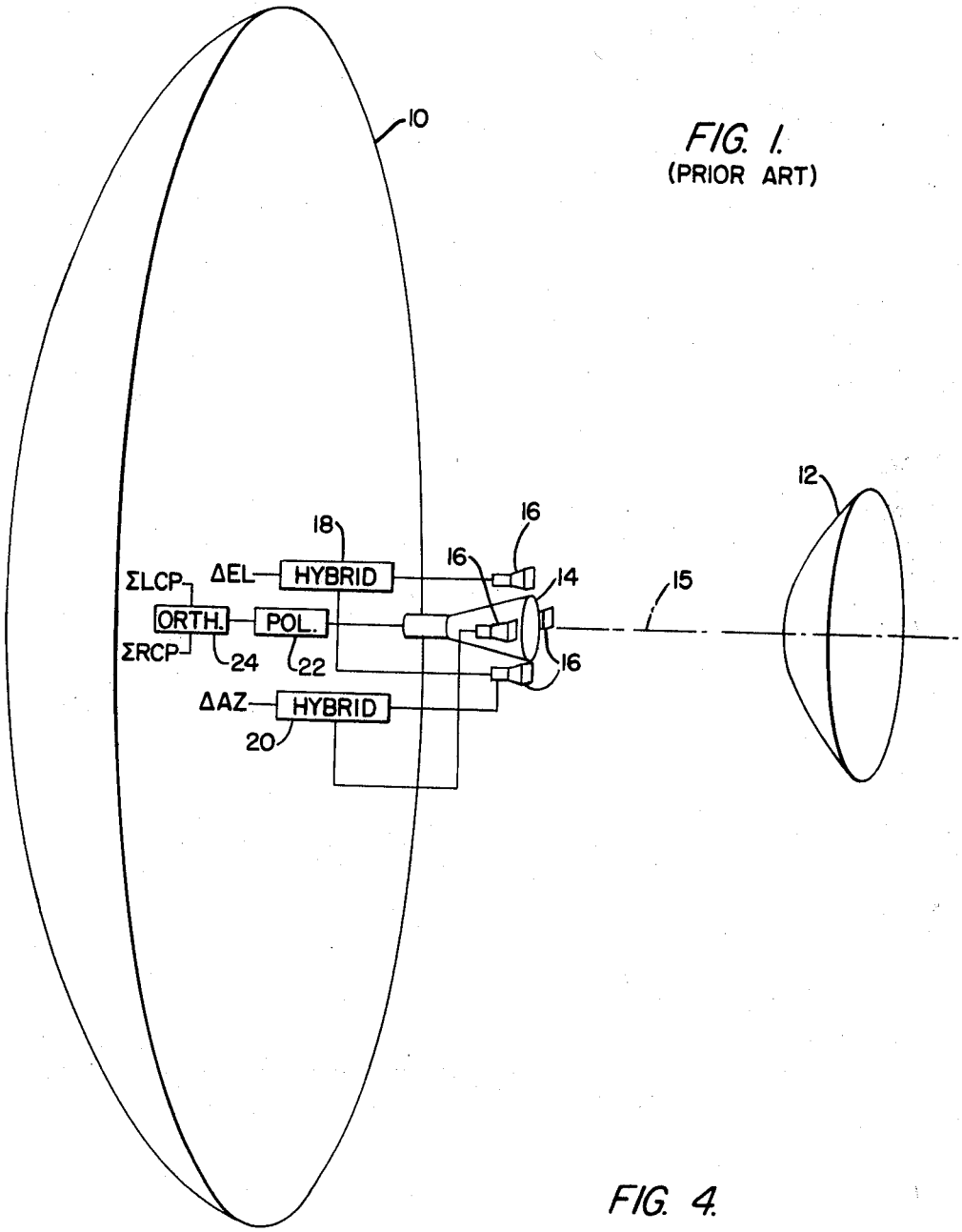
FIG. 1.
(PRIOR ART)
FIG. 4.
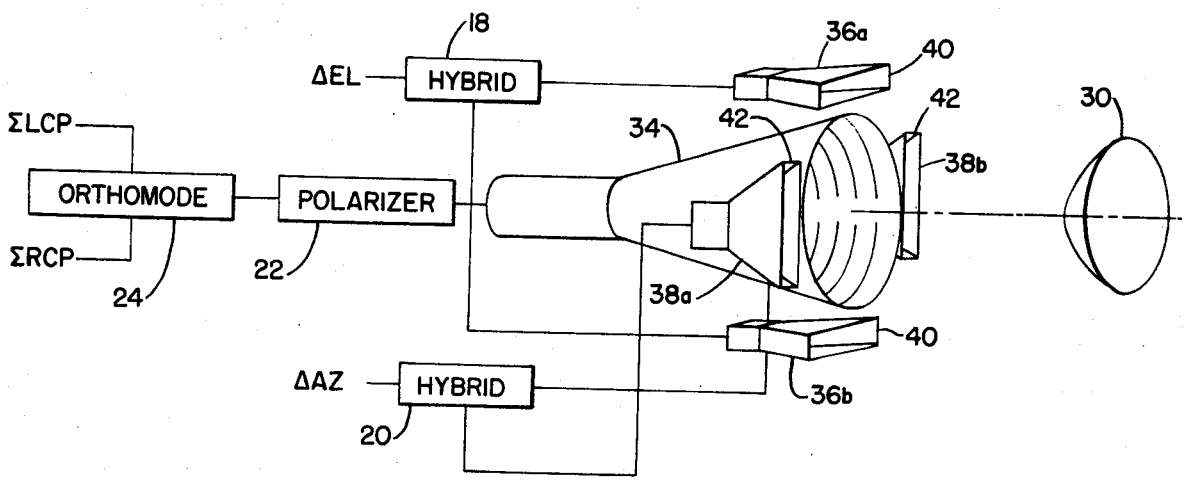

FIVE-HORN CASSEGRAIN ANTENNA

BACKGROUND OF THE INVENTION

This invention relates generally to antennas for communication systems which incorporate means for automatic target tracking, and more particularly, to the improvement of a Cassegrain antenna utilized with such an automatic tracking communication system.

A typical five-horn Cassegrain antenna, as shown in FIG. 1, comprises a concave main dish 10, a convex subreflector 12 located near the focal point of the main dish 10, and a set of five radiation feed elements which are illustrated as the horns 14 and 16 located between the main dish 10 and the subreflector 12. The subreflector is operable to reflect energy between these horns and the main dish 10. In the transmit mode, the energy impinging on the maindish 10 from the subreflector 12 will be reflected out into the atmosphere in the form of an in-phase wave. The five radiation feed elements noted above comprise a sum feed represented by horn 14 centered on the boresight axis 15 of the main dish 10 and four error feeds represented by the horns 16 equally spaced around this sum horn.

When the energy is radiated by a transmitter a substantial distance out in space (essentially a point source), some of the radiated energy will be intercepted by the main dish 10 and rereflected toward the subreflector located at the focal point of the main dish. The subreflector 12 will, in turn, reflect this energy into the apertures of the five antenna horns 14 and 16.

The four error horn elements will receive target echo signals which have relative amplitudes which are proportional to the angular position of the target in a plane perpendicular to the boresight axis of the parabolic dish. If the target is directly on the boresight axis of the parabolic dish, then the signals received by the four outer horns will all have equal amplitudes and will be in phase. If, however, the target is off the boresight axis by a particular angle, then the signals received by the four outer horns will have different amplitudes by a predetermined amount. The signals intercepted by these error horns are paired and combined in the hybrid circuits 18 and 20 in the conventional manner to generate an elevation error signal and an azimuth error signal. The sum horn is utilized to obtain a sum signal which contains the data to be communicated, and to provide a phase reference for the error horn signals. If the system utilizes circular polarization, a conventional polarizer 22 may be utilized in the sum channel in conjunction with a conventional orthomode circuit 24 for providing either left or right circular polarization. (The sum horn is also used to transmit the radiation utilized by the main dish 10 to form the plane wave and to receive any information being transmitted by the target (a satellite)). The elevation error and the azimuth error signals may be switched and phase shifted and further combined with the sum signal to simulate a single signal being sequentially shifted about the boresight axis. The amplitude modulation of this combined signal may then be used to provide tracking error information to the tracking servo elements of a tracking receiver.

A historical problem in the design of a five-horn Cassegrain antenna has been the trade-off between a sufficiently large sum horn for good illumination efficiency and a sufficiently small error horn spacing for adequate error channel secondary pattern crossover. The utilization of a large diameter sum horn is generally required in order to obviate sum horn radiation spillover at the periphery of the subreflector. FIG. 2 shows a wide sum horn main lobe with its attendant spillover. According to standard antenna theory, the dimensions of a radiating antenna in the plane normal to the direction of transmission must be at least several wavelengths, and preferably more before significant directivity is achieved. Thus, in order to increase the directivity of the sum horn (decrease the width of the sum horn lobe) the sum horn diameter must be increased. By increasing the directivity of the sum horn lobe and thus reducing the spillover of the radiation at the subreflector, more energy is radiated by the main dish in the form of in-phase plane waves thereby increasing the efficiency of the antenna and permitting its use in long-range applications.

However, while large diameter sum horns are desired, it is also necessary to minimize the separation of the horn centers of the four surrounding horns in order to prevent the crossover of these outer horn radiation patterns on the first sidelobe or beyond. Such first sidelobe crossover is not desirable because of the sensitivity of the low level first sidelobes to various factors including reflector distortion, frequency change, and blockage. Moreover, because the first sidelobe normally has a low level, it is difficult to determine the precise position of the null in the crossover so as to generate the azimuth and elevation error signals. Therefore, prior art systems have generally tried to space the error horns so that the error horns secondary pattern crossover is on the main offset lobe or at the first null. The radiation pattern resulting from such a spacing is shown in FIG. 2 wherein the dashed line pattern is the radiation pattern from the error horn 16A and the solid line radiation pattern is the radiation pattern from the error horn 16B. Since these error horn radiation patterns crossover at the null between the first and second lobes, this results in the detection of the null which has a rapidly increasing amplitude on either side thereof when these two radiation patterns are combined. This rapidly increasing amplitude permits the precise location of the null position thus facilitating the accurate determination of the azimuth and elevation error signals. However, when the error horn spacing is fixed as shown in FIG. 2 so that the error horn's secondary pattern crossover is at the first null, the sum horn aperture size is such that a large spillover past the subreflector is incurred. This spillover is shown, as noted above, in FIG. 2 wherein the lined area on the periphery of the sum horn radiation pattern constitutes the radiation spillover. If the sum horn diameter is increased to reduce this spillover, the error horn spacing must also be increased, resulting in a crossover on the first sidelobe as shown in FIG. 3 where the dashed line and solid line patterns again represent the radiation patterns from the error horns 16A and 16B, respectively. Such a first sidelobe crossover clearly results in low amplitude signals on either side of the detected null.

OBJECTS OF THE INVENTION

Accordingly, an object of the present invention is to decrease radiation spillover while at the same time providing an error horn radiation pattern crossover which results in a difference signal null wherein the amplitudes of the signal on either side of the null increase rapidly.

A further object of the present invention is to increase the illumination efficiency of the antenna while at the same time providing an error horn radiation pattern crossover which facilitates the accurate determination of the difference null.

A still further object of the present invention is to increase the illumination efficiency of the antenna while decreasing its tracking sensitivity to reflector distortion, frequency change, blockage, and defocussing.

These and further objects, features and advantages of the present invention will become more obvious from the following description when taken in connection with the accompanying drawings which show, for purposes of illustration only, a single embodiment in accordance with the present invention.

SUMMARY OF THE INVENTION

The foregoing objects are accomplished in a multiple-feed Cassegrain antenna which includes a main dish, a subreflector appropriately positioned on the boresight axis of this dish, and including a sum feed located on the boresight axis and a plurality of error feed elements located therearound appropriately positioned between the subreflector and the main dish, wherein the subreflector utilizes an up-taper design, the sum feed has a large radiating aperture to substantially reduce subreflector spillover, the four error feeds are positioned so that there is a secondary pattern crossover, and a high aspect ratio is utilized for the error feed configurations with the narrow dimension of each error feed being located in the plane of its tracking crossover with a second one of the error horns with which it is paired. The large aperture sum feed enhances the antenna illumination efficiency while the outward positioning of the error feeds in conjunction with the up-tapered subreflector and the large aspect ratio of the error feeds provide error feed radiation pattern sidelobes with substantially increased levels thereby enhancing null position detection accuracy.

BRIEF DESCRIPTION OF THE DRAWINGS

FIG. 1 is a diagram showning a prior art configuration of a five-horn Cassegrain antenna utilized in a monopulse application;

FIG. 4 is a block diagram of a five-horn Cassegrain antenna utilizing high aspect ratio error horns as taught by the present invention;

DETAILED DESCRIPTION OF THE PREFERRED EMBODIMENTS

Figure 2:
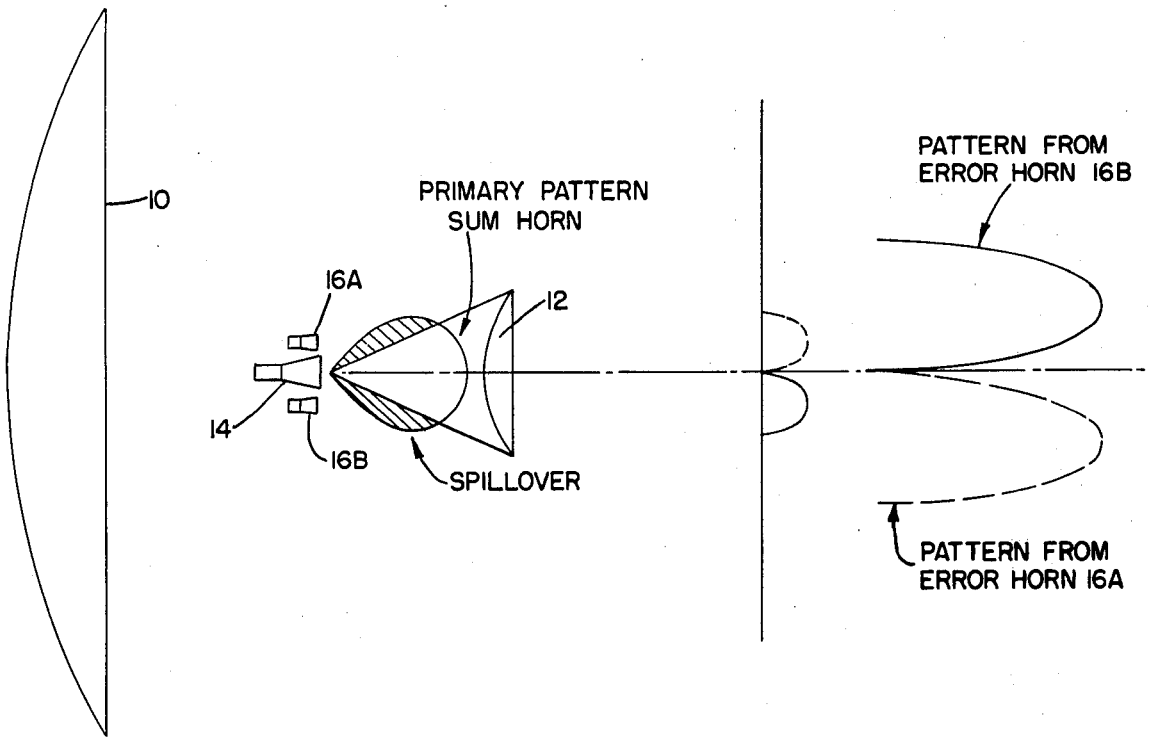
FIG. 2. (PRIOR ART)
FIG. 2 is a graphical illustration of the radiation patterns of the error horn 16A and 16B and the primary pattern of a narrow aperture sum horn.
Figure 3:
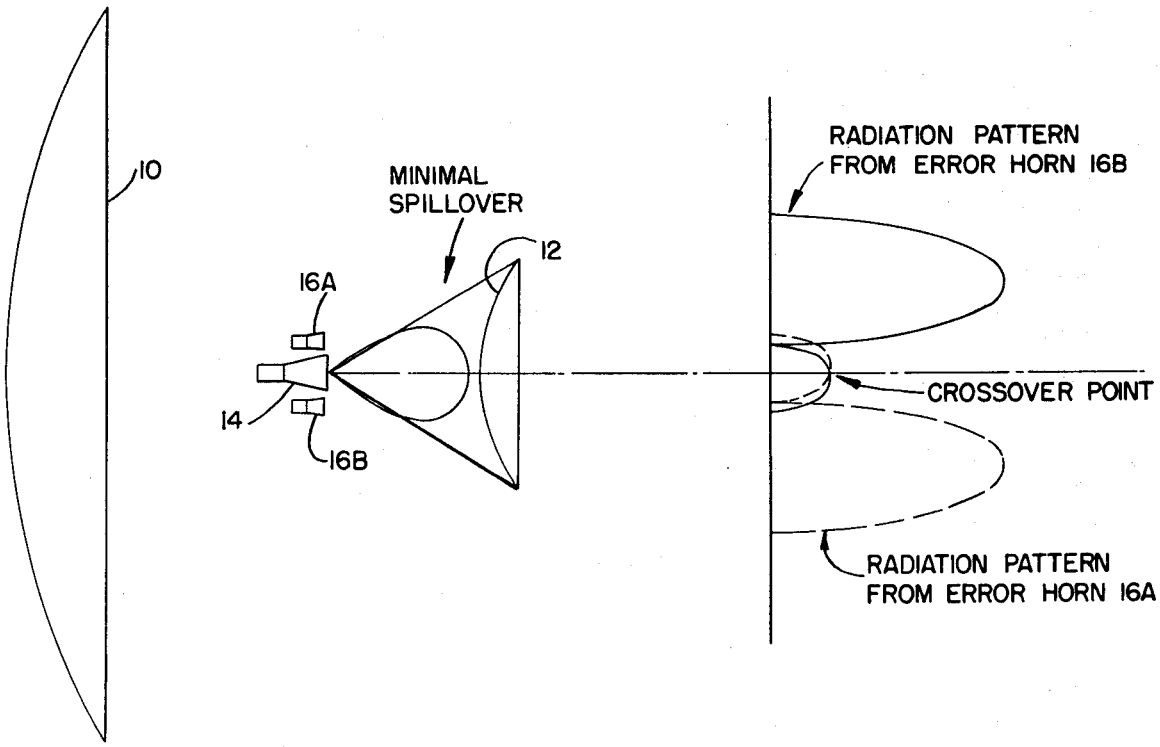
FIG. 3 is a graphical illustration of the radiation patterns of the error horns 16A and 16B and the primary pattern for a large aperture sum horn 14.

Referring now to FIG. 4, there is disclosed one embodiment of a five-element Cassegrain antenna utilizing the teachings of the present invention. Therein there is shown an enlarged sum horn 34 located on the boresight axis of the main dish (not shown) of the type shown in FIG. 1. Positioned around this sum horn 34 are four error horns 36A, 36B, 38A, and 38B, with high aspect ratio apertures. The hybrid circuits 18 and 20, the polarizer 22, and the orthomode circuit 24 are connected in the same manner and operate identically to the same-numbered elements shown in FIG. 1.

A subreflector 30 is appropriately positioned on the boresight axis of the main dish (not shown) in order to reflect radiation energy between the main dish and the five horns noted above. This subreflector 30 has a tapered configuration of the same type as that disclosed in the Victor Galindo article "Design of Dual-Reflector Antennas with Arbitrary Phase and Amplitude Distributions" IEEE, PGAP; July, 1964; pages 403–408. More specifically, the shapes of the subreflector 30 and the main dish corresponding thereto are defined by the table of dimension values in Table 1. The dimensions $X_1$ and $Y_1$ define the subreflector shape with respect to the $X_1$, $Y_1$, axes shown in FIG. 5. (See attached Table 1).

Figure 5:
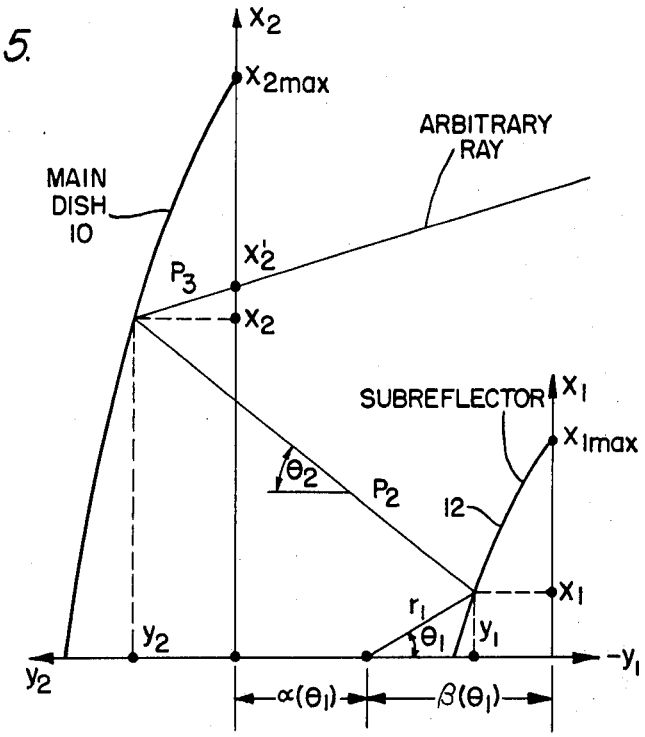
FIG. 5 is a diagram defining the values in Table 1.

The dimensions $X_2$ and $Y_2$ define the shape of the main dish with respect to the axes $X_2$ $Y_2$ shown in FIG. 5. The angles $\theta_1$ and $\theta_2$ are defined as shown in FIG. 5 and the axes $X_1Y_1$ and $X_2Y_2$ are separated by a distance $\alpha\theta_1+\beta\theta_1$ where $\alpha=-1.71$ and $\beta=16.62$. The foregoing angles and dimensions were obtained by the computer simultaneous solution of the following four differential equations substantially in accordance with the Galindo article:

(1) The electro-magnetic radiation amplitude distribution equation at the main dish;

(2) Snell's law at the subreflector;

(3) Snell's law at the main dish; and (4) The constant path-length equation (theorem of Malus) derived from the fact that surfaces of constant phase form normal surfaces to ray trajectories; and this normal congruence is maintained after any number of reflections.

Figure 6A:
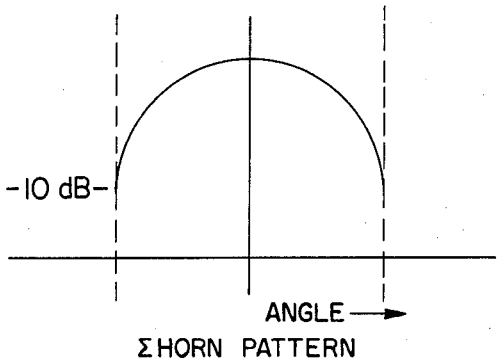
FIG. 6*a* is a graphical representation of a sum horn radiation pattern.
Figure 6B:
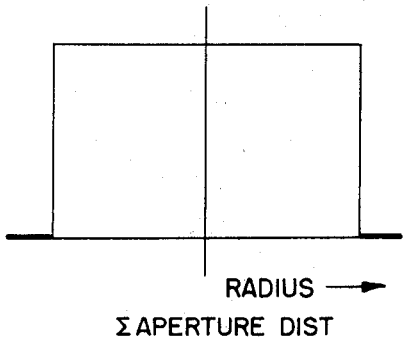
FIG. 6*b* is a graphical representation of a uniform radiation distribution received by the sum horn due to the use of an up-taper subreflector.

Galindo, in formulating this design, was attempting to decrease radiation spillover past the subreflector edges while at the same time providing a uniform illumination of the main dish. Thus, Galindo's subreflector was designed such that although the sum radiation pattern illuminating the subreflector drops 12 db at the edge of the subreflector, the subreflector is shaped such that a portion of the radiation from the center of the subreflector is deflected to the outer edges of the main dish to add to the low level radiation (12 db down) normally reflected from the edges of the subreflector to the outer edges of the main dish. Thus, this design permits the uniform illumination of the main dish by the sum horn while at the same time reducing spillover past the subreflector. FIG. 6*a* illustrates the sum horn radiation pattern (radiation level in db vs. angle). FIG. 6*b* illustrates the uniform radiation distribution received by the sum horn due to the use of the up-tapered subreflector.

Figure 6C:
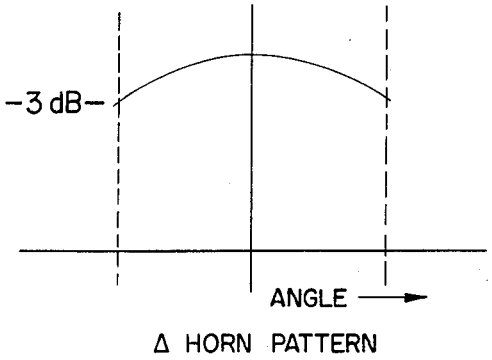
FIG. 6*c* is a graphical representation of an error horn radiation pattern.
Figure 6D:
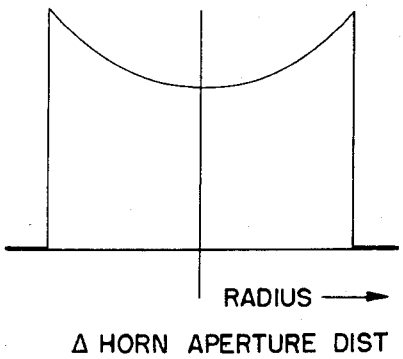
FIG. 6*d* is a graphical representation of the error horn aperture distribution due to the use of an up-taper subreflector.

Applicant has discovered a second effect obtained from the utilization of this up-taper subreflector. It has been discovered that the sidelobes of the radiation patterns for the error horns are increased by a certain amount due to the up-taper of the subreflector. This is caused primarily by the fact that the main lobe of the error horn radiation pattern is relatively wide or fat due to its small aperture. Thus, radiation therefrom completely encompasses the subreflector such that at the edge of the subreflector the radiation is down only 3 db. Since the illumination of the edges of the subreflector is now almost equal to the illumination of the center of the subreflector, the addition of the radiation from the edges of the subreflector and a certain portion of the radiation from the center of the subreflector will provide radiation at the edges of the dish, greater than the radiation at the center of the dish. This inverted illumination of the main dish will cause the secondary lobes or sidelobes of the radiation patterns of the error horns to increase. This is true both for the transmitting and the receiving mode of the error horns. FIG. 6*c* illustrates the error horn radiation pattern (radiation level in db vs. angle). FIG. 6*d* illustrates the error horn aperture distribution caused by the use of the up-taper subreflector.

It should be noted that the foregoing table of dimensions was derived to meet $X_1$, $X_2$ and $\theta_1$, maximum constraints peculiar to applicant's particular use. Thus, applicant's invention is not limited to the particular subreflector and main dish shapes disclosed in Table 1. In fact, the only significant constraint on these shapes in that the resulting radiation output reflected by the subreflector toward the error horn configuration has an inverted illumination pattern, i.e., the radiation at the edges of the output pattern is greater than the radiation at the center of the pattern.

As noted above, when the dimensions of a radiating antenna are increased to several wavelengths or more in the plane normal to the desired direction of transmission, the directivity of the antenna radiation pattern is increased. Thus, in this instance, the rectangular error horns are designed with the narrow dimension in the plane of the associated tracking crossover so as to increase the directivity of the radiation pattern in this plane thereby increasing the primary and secondary radiation patterns. This design feature is illustrated in FIGS. 1 and 4 wherein the aspect ratios for the error horns are seen to be large. Thus, for example, the vertical or elevation plane dimension 40 is narrow for the error horns 36A and 36B to thereby provide high error horn sidelobes which may be utilized to obtain the elevation tracking error. In the same manner, the azimuth plane dimension 42 for the error horns 38A and 38B are narrow in order to increase the error horn sidelobes used to obtain the azimuth tracking error.

Figure 7:
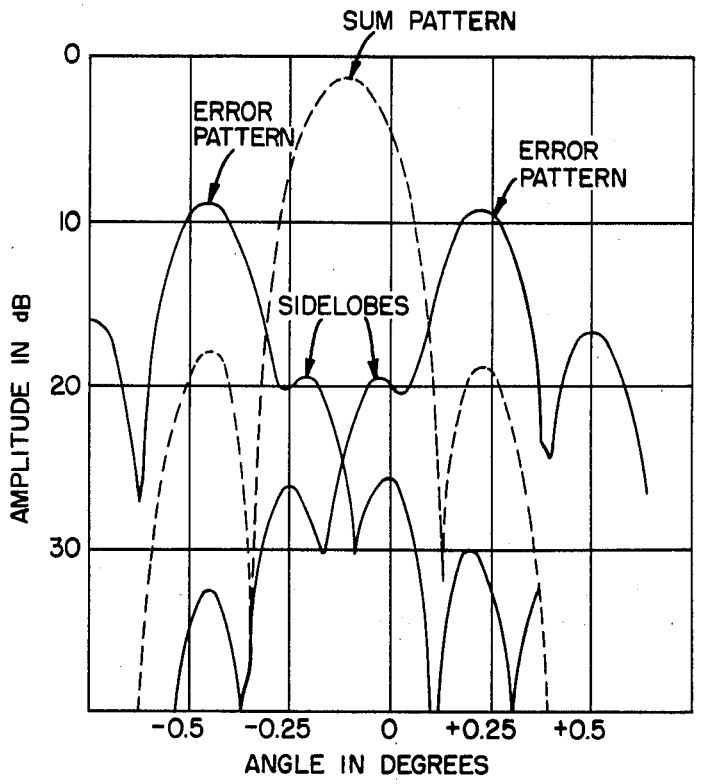
FIG. 7 is a graphical representation of the primary and secondary radiation patterns of the error horns 16A and 16B and the primary pattern of the sum horn when the teachings of the present invention are utilized.
Figure 8:
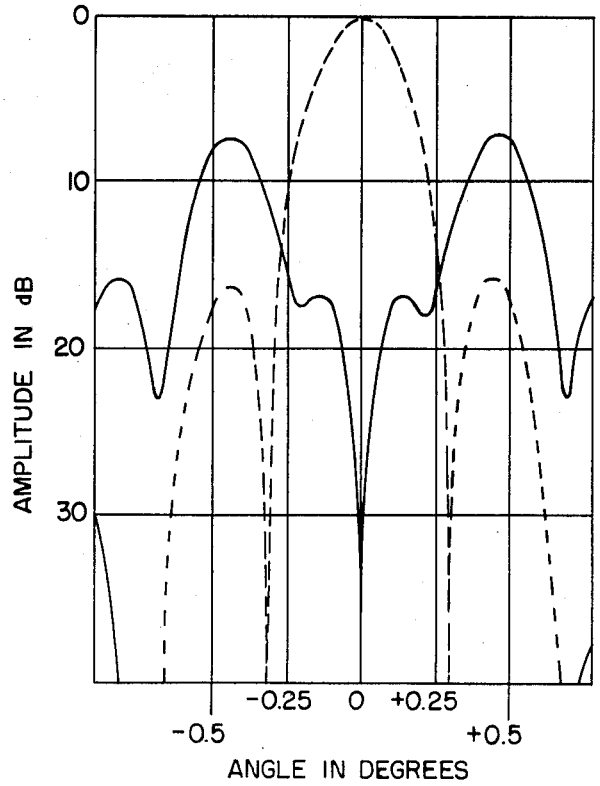
FIG. 8 is a graphical representation of the sum and error radiation patterns when the teachings of the present invention are utilized.

Thus, the combination of error horns with high-aspect ratios and an up-tapered subreflector provide error horn sidelobe patterns which have sufficiently high levels to be utilized in tracking. Stated another way, when the error horn sidelobe patterns of paired error horns are subtracted from each other to obtain a null, the radiation signal levels on either side of this null rise steeply thereby providing an accurate pattern for determining the correct position of the null. These high sidelobes are shown in FIG. 7 which sets forth the individual radiation patterns for two paired error horns. The dashed line pattern illustrates the position of the sum horn pattern. FIG. 8 shows the difference radiation pattern that would be obtained at the output of one of the hybrid circuits 18 or 20 when the error horn patterns of FIG. 7 are subtracted. Again, the dashed line illustrates the position of the sum horn pattern.

In view of the high sidelobe patterns obtained from the error horns, the spacing between the error horns may be increased such that the error horn patterns crossover in their sidelobes while still permitting an accurate determination of the null position. Thus, this design permits the substantial enlargement of the sum horn thereby increasing its directivity and reducing its spillover at the subreflector while at the same time obtaining accurate positioning of the null in the subtracted error patterns.

Figure 9:
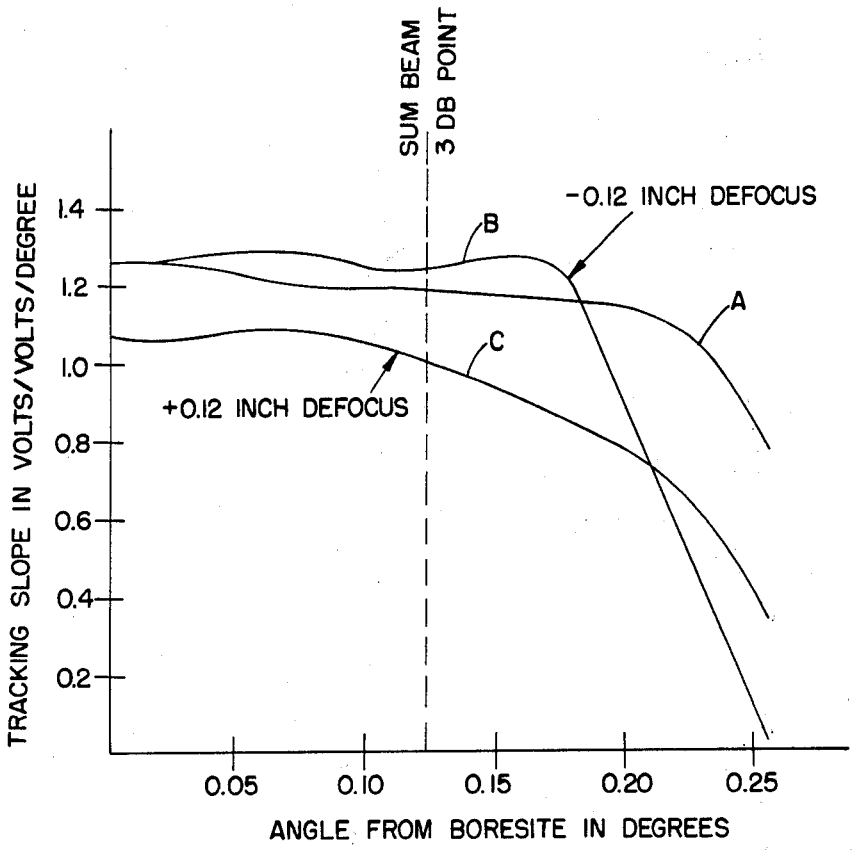
FIG. 9 is a graphical representation of Tracking Slope vs. Angle from Boresight when the teachings of the present invention are utilized.

Measurements taken with an antenna utilizing the present design disclose that the tracking slope (difference pattern energy divided by sum pattern energy expressed in percent) which measures the energy available at a particular angle off boresight for aligning the receiver is flatter over a greater range of angles from the boresight axis than conventional antennas as shown in FIG. 9, curve A. Curves B and C show the tracking slope obtained with a 0.12 inch defocus (feed and subreflector on the boresight axis but too far or too close to the main dish). These curves demonstrate a clear antenna insensitivity to defocus.

Further measurements taken at 15.1 GHz with the feed mispointed (the feed is not properly aligned on the boresight axis) 0.4 beamwidths also show a clear insensitivity to mispointing.

Although the embodiment discussed above utilized orthogonal linear polarizations for the two tracking planes, applicant's invention is not limited thereto, but is also applicable where the same linear polarization is utilized in the two tracking planes, or where circularly polarized error horns are utilized.

To summarize, the present invention makes possible the crossover of the error horn patterns in the first sidelobes thereby permitting an increased sum horn dimension while at the same time retaining an accurate determination of the null position. The technique of increasing the first sidelobes of the error horn patterns to permit first sidelobe crossover has the effect of making these first sidelobe patterns insensitive to reflector distortion, defocus, mispointing, blockage, and frequency change.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

TABLE 1

| X1 | Y1 | θ1 | X2 | Y2 | θ2 |
|---|---|---|---|---|---|
| 11.00000 | .00000 | 33.500 | 93.60000 | .00000 | 79.77171 |
| 10.37238 | .26882 | 32.390 | 92.02800 | 1.30403 | 78.95460 |
| 9.84992 | .49362 | 31.418 | 90.48600 | 2.58670 | 78.09122 |
| 9.38964 | .69191 | 30.521 | 88.84400 | 3.85338 | 77.19659 |
| 8.98714 | .87377 | 29.662 | 87.31200 | 5.09771 | 76.27949 |
| 8.56104 | 1.04530 | 28.817 | 85.74000 | 6.32153 | 75.34536 |
| 8.16529 | 1.21020 | 27.972 | 84.16800 | 7.92476 | 74.39760 |
| 7.80492 | 1.37074 | 27.115 | 82.59600 | 8.70338 | 73.43832 |
| 7.43874 | 1.52425 | 26.240 | 81.02400 | 9.86943 | 72.46883 |
| 7.07401 | 1.64355 | 25.344 | 79.45200 | 11.01094 | 71.48488 |
| 6.62294 | 1.87424 | 24.189 | 77.48700 | 12.40906 | 70.25343 |

TABLE 1-continued

| X1 | Y1 | θ1 | X2 | Y2 | θ2 |
|---|---|---|---|---|---|
| 6.26532 | 2.02101 | 23.237 | 75.91500 | 13.50462 | 69.25439 |
| 5.91251 | 2.17880 | 22.263 | 74.34300 | 14.57985 | 68.24535 |
| 5.59068 | 2.31293 | 21.345 | 72.77100 | 15.63466 | 67.21014 |
| 5.30093 | 2.43499 | 20.492 | 71.19900 | 16.66873 | 66.14658 |
| 5.03714 | 2.54551 | 19.695 | 69.62700 | 17.68177 | 65.05708 |
| 4.79478 | 2.64625 | 18.940 | 68.05500 | 18.67356 | 63.94338 |
| 4.57036 | 2.73863 | 18.225 | 66.48500 | 19.64391 | 62.80682 |
| 4.36118 | 2.82376 | 17.543 | 64.91100 | 20.59265 | 61.64843 |
| 4.16507 | 2.90261 | 16.891 | 63.33900 | 21.51966 | 60.46903 |
| 3.98929 | 2.97546 | 16.264 | 61.76700 | 22.42481 | 59.26929 |
| 3.80580 | 3.04415 | 15.659 | 60.19500 | 23.30801 | 58.04978 |
| 3.63919 | 3.10798 | 15.075 | 58.62300 | 24.16915 | 56.81097 |
| 3.480066 | 3.16780 | 14.508 | 57.05100 | 25.00817 | 55.55329 |
| 3.32895 | 3.22398 | 13.956 | 55.47900 | 25.82499 | 54.27712 |
| 3.18333 | 3.27684 | 13.419 | 53.90700 | 26.61955 | 52.98281 |
| 3.04315 | 3.32666 | 12.895 | 52.33500 | 27.39180 | 51.67068 |
| 2.90785 | 3.37368 | 12.382 | 50.76300 | 28.14169 | 50.34108 |
| 2.77694 | 3.41812 | 11.879 | 49.19100 | 28.86916 | 48.99431 |
| 2.64997 | 3.46017 | 11.386 | 47.61900 | 29.57419 | 47.63070 |
| 2.52654 | 3.49999 | 10.901 | 46.04700 | 30.25673 | 46.25058 |
| 2.40629 | 3.53774 | 10.423 | 44.47500 | 30.91676 | 44.85430 |
| 2.28889 | 3.57356 | 9.981 | 42.90300 | 31.55425 | 43.44222 |
| 2.17404 | 3.60797 | 9.485 | 41.33100 | 32.16917 | 42.01471 |
| 2.86127 | 3.43084 | 9.024 | 39.75900 | 32.76151 | 40.57219 |
| 1.95067 | 3.67062 | 8.567 | 38.18700 | 33.33124 | 39.11508 |
| 1.84103 | 3.69984 | 8.113 | 36.61500 | 33.87836 | 37.64386 |
| 1.73393 | 3.73768 | 7.661 | 35.04300 | 34.40284 | 36.15904 |
| 1.62739 | 3.75421 | 7.209 | 33.47100 | 34.90468 | 34.66118 |
| 1.52157 | 3.77952 | 6.758 | 31.89900 | 35.38384 | 33.15088 |
| 1.41615 | 3.80370 | 6.306 | 30.32700 | 35.84043 | 31.62885 |
| 1.31073 | 3.82685 | 5.850 | 28.75500 | 36.27437 | 30.09587 |
| 1.20481 | 3.84906 | 5.390 | 27.18300 | 36.68568 | 28.55285 |
| 1.09776 | 3.87046 | 4.921 | 25.61100 | 37.07438 | 27.00089 |
| .98872 | 3.89119 | 4.442 | 24.03900 | 37.44050 | 25.44135 |
| .87645 | 3.91145 | 3.945 | 22.46700 | 37.78410 | 23.87606 |
| .75903 | 3.93151 | 3.424 | 20.89500 | 38.10524 | 22.30765 |
| .65505 | 3.99188 | 2.861 | 19.32300 | 38.40403 | 20.74037 |
| .49136 | 3.97355 | 2.225 | 17.75100 | 38.68065 | 19.18265 |
| .31258 | 3.99955 | 1.419 | 16.17900 | 38.93548 | 17.65868 |
| .00000 | 4.04428 | .000 | 15.00000 | 39.11305 | 16.70776 |

I claim:

1. An antenna for generating sum and difference patterns for use in tracking applications comprising:

a concave main dish having a boresight axis;

a subreflector having a tapered configuration positioned on said boresight axis;

a sum horn having a large radiating aperture for generating a sum radiation pattern with good directivity, said sum horn being positioned on said boresight axis between said main dish and said subreflector such that said directive sum radiation pattern is intercepted by said subreflector and reflected therefrom to illuminate said main dish to thereby generate a radiation output wave;

a plurality of error horns, said error horns being appropriately positioned around said sum horn such that the radiation pattern of each error horn and a second error horn with which it is paired crossover in the sidelobes of their respective patterns and such that said error horns receive radiation reflected from said subreflector with the highest radiation levels being found on the outer edges of the apertures of said error horns to thereby enhance their respective sidelobes; and means responsive to signals representative of the radiation patterns received at said sum and error horns for appropriately combining these signals to obtain azimuth and elevation error signals.

2. An antenna as defined in claim 1, wherein each error horn in said plurality of error horns has a radiating aperture with a relatively large aspect ratio, the narrow dimension of each error horn aperture being in the plane of the crossover of its radiation pattern with the radiation pattern of the second error horn with which it is paired.

3. An antenna as defined in claim 2, wherein said error horns comprise four substantially rectangular horns.

4. An antenna as defined in claim 2, wherein said subreflector is tapered in an up-taper configuration.

5. An antenna for generating a plurality of radiation patterns which may be appropriately combined to obtain azimuth and elevation error signals for use in tracking applications comprising:

a concave main dish with a boresight axis;

a subreflector with an up-taper configuration positioned on said boresight axis;

a central horn with a large radiating aperture for generating a central radiation pattern with substantial directivity, said central horn being positioned on said boresight axis between said main dish and said subreflector such that said central radiation pattern is intercepted by said subreflector with minimal radiation spillover and reflected therefrom to illuminate said main dish; and a plurality of error horns appropriately positioned around said central horn such that the radiation pattern from each error horn crosses over the radiation pattern of a second error horn in the sidelobes of their respective radiation patterns, each of said error horns having a large aspect ratio with the narrow dimension of each of said error horn apertures being in the plane of the crossover of its radiation pattern with the radiation pattern of said second error horn, said error horn radiation patterns thereby having high sidelobes.

6. An antenna as defined in claim 5, wherein said plurality of error horns comprise four substantially rectangular horns.

7. A cassegrain antenna for generating sum and difference patterns for use in tracking applications comprising:

a concave main dish having a boresight axis;

a subreflector having a tapered configuration positioned on said boresight axis;

a sum horn having a large radiating aperture for generating a sum radiation pattern with good directivity, said sum horn being positioned on said boresight axis between said main dish and said subreflector such that said directive sum radiation pattern is intercepted by said subreflector and reflected therefrom to illuminate said main dish to thereby generate a radiation output wave;

a plurality of error horns, said error horns being appropriately positioned around said sum horn such that the radiation pattern of each error horn and a second error horn with which it is paired crossover in the sidelobes of their respective patterns; and means responsive to signals representative of the radiation patterns received at said sum and error horns for appropriately combining these signals to obtain azimuth and elevation error signals; and wherein the tapered configuration of said subreflector is such that the resulting radiation output reflected by said subreflector towards said plurality of error horns has an inverted illumination pattern, whereby the radiation at the edges of the output pattern is greater than the radiation at the center of the pattern.

* * * * *